US010942013B2

(12) United States Patent
Zemany et al.

(10) Patent No.: US 10,942,013 B2
(45) Date of Patent: Mar. 9, 2021

(54) GUIDANCE, NAVIGATION AND CONTROL FOR BALLISTIC PROJECTILES

(71) Applicant: BAE Systems Information and Electronic Systems Integration Inc., Nashua, NH (US)

(72) Inventors: Paul D. Zemany, Amherst, NH (US); Matthew F. Chrobak, Groton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/754,822

(22) PCT Filed: Aug. 30, 2019

(86) PCT No.: PCT/US2019/048979
§ 371 (c)(1),
(2) Date: Apr. 9, 2020

(87) PCT Pub. No.: WO2020/047364
PCT Pub. Date: Mar. 5, 2020

(65) Prior Publication Data

US 2020/0400412 A1 Dec. 24, 2020

Related U.S. Application Data

(60) Provisional application No. 62/725,568, filed on Aug. 31, 2018.

(51) Int. Cl.
*F42B 10/64* (2006.01)
*F41G 7/36* (2006.01)
(Continued)

(52) U.S. Cl.
CPC ..... *F42B 10/64* (2013.01); *F41G 7/008* (2013.01); *F41G 7/226* (2013.01); *F41G 7/2213* (2013.01);
(Continued)

(58) Field of Classification Search
CPC .. F42B 10/64; F42B 10/26; F41G 7/36; F41G 7/2213; F41G 7/2293; F41G 7/2253;
(Continued)

(56) References Cited

U.S. PATENT DOCUMENTS 4,128,837 A * 12/1978 Page ..... F41G 7/36 235/412
5,435,503 A * 7/1995 Johnson, Jr. ..... F41G 7/008 244/3.15
(Continued)

FOREIGN PATENT DOCUMENTS

WO 2013111138 A1 8/2013
WO 2018122838 A1 7/2018

OTHER PUBLICATIONS

International Search Report, PCT/US19/51871, 10 pages, dated Nov. 12, 2019.
(Continued)

*Primary Examiner* — Bernarr E Gregory
(74) *Attorney, Agent, or Firm* — Scott J Asmus; Sand, Sebolt & Wernow LPA

(57) ABSTRACT

A system and method to aid in guidance, navigation and control of a guided projectile including a precision guidance munition assembly. The system and method receive position estimates of the guided projectile from a guiding sensor, determine predicted impact points of the guided projectile relative to a target based on the position estimates, determine miss distances of the guided projectile relative to the target, determine smoothed miss distances based, at least in part, on
(Continued)

the determined miss distances, and process updated steering commands to steer the guided projectile based on the smoothed miss distances.

20 Claims, 6 Drawing Sheets

(51) Int. Cl.

| | |
|---|---|
| ***F41G 7/22*** | (2006.01) |
| ***F42B 10/26*** | (2006.01) |
| ***F41G 7/00*** | (2006.01) |
| ***F41G 7/34*** | (2006.01) |
| *F42B 10/00* | (2006.01) |

(52) U.S. Cl.
CPC ..... *F41G 7/2253* (2013.01); *F41G 7/2293* (2013.01); *F41G 7/36* (2013.01); *F42B 10/26* (2013.01); *F41G 7/346* (2013.01)

(58) Field of Classification Search
CPC ..... F41G 7/008; F41G 7/226; F41G 7/346; F41G 7/26; F41G 7/306; G01S 13/72; G05B 13/026; G05D 1/105
See application file for complete search history.

(56) References Cited

U.S. PATENT DOCUMENTS

| | | | | |
|---|---|---|---|---|
| 5,811,788 | A * | 9/1998 | Wicke | F41G 7/306 244/3.1 |
| 6,138,944 | A * | 10/2000 | McCowan | F41G 7/26 244/3.1 |
| 7,147,181 | B2 * | 12/2006 | Selin | F42B 10/64 244/3.27 |
| 7,394,047 | B1 | 7/2008 | Pedersen | |
| 7,533,849 | B2 | 5/2009 | Zemany et al. | |
| 7,834,300 | B2 | 11/2010 | Zemany et al. | |
| 8,450,668 | B2 | 5/2013 | Maynard et al. | |
| 8,729,442 | B2 * | 5/2014 | Boelitz | G05D 1/105 244/3.1 |
| 9,115,968 | B1 * | 8/2015 | Abruzzo | F41G 7/008 |
| 10,317,852 | B1 * | 6/2019 | Spooner | G05B 13/026 |
| 10,520,291 | B1 | 12/2019 | Vasudevan et al. | |
| 10,677,909 | B2 * | 6/2020 | Van Ommeren | G01S 13/72 |
| 2008/0029641 | A1 | 2/2008 | Carlson et al. | |
| 2009/0127377 | A1 * | 5/2009 | Lam | F41G 7/008 244/3.2 |

OTHER PUBLICATIONS

Palumbo et al., "Modern Missile Guidance Theory and Techniques" Johns Hopkins APL Technical Digest, vol. 29, No. 1 (2010), U.S.

* cited by examiner

GUIDANCE, NAVIGATION AND CONTROL FOR BALLISTIC PROJECTILES

CROSS REFERENCE TO RELATED APPLICATIONS

This application claims the benefit of U.S. Provisional Patent Application No. 62/725,568, filed Aug. 31, 2018, the content of which is incorporated by reference herein its entirety.

BACKGROUND

Technical Field

The present disclosure relates generally to guiding projectiles. More particularly, the present disclosure relates to providing a predicted impact point and a smoothed miss distance of a guided projectile relative to a target. Specifically, the present disclosure relates to guiding a projectile based, at least in part, on a predicted impact point and a smoothed miss distance of the guided projectile relative to a target via an update steering command.

Background Information

Guided projectiles are typically limited in how much they can maneuver. Thus, the maneuver authority of a guided projectile is an important component in launching the guided projectile. When the guided projectile is launched from a launch assembly, such as a barrel or gun tube, the guided projectile may travel along a trajectory, and, if no corrective action is taken, the guided projectile may impact an impact point that is a distance away from the target. In order for the guided projectile to more precisely hit the target, the trajectory of the guided projectile may need to be modified. An accurate estimate of a miss distance is typically required to correct the trajectory of the guided projectile so that the guided projectile will impact an area proximate the target.

SUMMARY

Issues continue to exist with methods for providing an accurate predicted impact point and a smoothed miss distance. The present disclosure provides a system and method to predict impact points of a guided projectile, including a precision guidance munition assembly relative to a target. The system and method determine miss distances of the guided projectile relative to the target, smooth the miss distances of the guided projectile relative to the target, and process updated steering commands to steer the guided projectile based on the smoothed miss distances.

In one aspect, the present disclosure provides a precision guidance munition assembly for a guided projectile, comprising a canard assembly including at least one canard that is moveable, at least one guiding sensor coupled to the precision guidance munition assembly, and at least one non-transitory computer-readable storage medium carried by the precision guidance munition assembly having a instructions encoded thereon that when executed by at least one processor operates to aid in guidance, navigation and control of the guided projectile.

The instructions in one example include receiving a first position estimate of the guided projectile from the guiding sensor. Determining a first predicted impact point of the guided projectile relative to a target based on the first position estimate. Determining a first miss distance of the guided projectile relative to the target. Receiving a second position estimate of the guided projectile from the guiding sensor. Determining a second predicted impact point of the guided projectile relative to the target based on the second position estimate. Determining a second miss distance of the guided projectile relative to the target. Determining a smoothed miss distance based, at least in part, on the first determined miss distance and the second determined miss distance. Additionally the instructions may include processing an updated steering command to command the at least one canard on the canard assembly to steer the guided projectile based on the smoothed miss distance.

In one example, the at least one canard includes a first lift canard, a second lift canard, a first roll canard and a second roll canard.

The first predicted impact point and the second predicted impact point of the guided projectile in one example are predicted by utilizing a projectile dynamics model. The projectile dynamics model in one example is a three degree-of-freedom (DOF) model including, at least in part, a Jacobian reference, a drag profile, or a steering Jacobian reference accounting for, at least in part, steering applied to the guided projectile. Further, a five DOF model, a six DOF model, or a seven DOF model may be utilized. Although particular projectile dynamics models have been described, other suitable projectile dynamics model may be utilized.

In one example, the smoothed miss distance is a weighted miss distance determined by, at least in part, a weighted sum of the first determined miss distance and the second determined miss distance. In another example, a low pass filter is utilized to determine the smoothed miss distance by filtering the determined miss distances. Although methods of determining the smoothed miss distances have been described, the smoothed miss distances may be determined in other suitable manners.

In another aspect, the present disclosure provides a method for guiding a guided projectile wherein the method comprises the following elements. Receiving a first position estimate of a guided projectile including a precision guidance munition assembly from a guiding sensor, wherein the precision guidance munition assembly includes a canard assembly including at least one canard that is moveable. Determining a first predicted impact point of the guided projectile relative to a target based on the first position estimate. Determining a first miss distance of the guided projectile relative to the target. Receiving, a second position estimate of the guided projectile from the guiding sensor. Determining a second predicted impact point of the guided projectile relative to the target based on the second position estimate. Determining a second miss distance of the guided projectile relative to the target. Determining a smoothed miss distance based, at least in part, on the first determined miss distance and the second determined miss distance. Additionally the method may include processing an updated steering command to command the at least one canard on the canard assembly to steer the guided projectile based on the smoothed miss distance.

In one example, the at least one canard includes a first lift canard, a second lift canard, a first roll canard and a second roll canard.

In one example, the smoothed miss distance is a weighted miss distance determined by, at least in part, a weighted sum of the first determined miss distance and the second determined miss distance. In another example, a low pass filter is utilized to determine the smoothed miss distance by filtering the determined miss distances. Although methods of determining the smoothed miss distances have been described, the smoothed miss distances may be determined in other suitable manners.

The first predicted impact point and the second predicted impact point of the guided projectile may be predicted by utilizing a projectile dynamics model.

In one example, the projectile dynamics model may be a three DOF model including, at least in part, a Jacobian reference and a drag profile. In this example, the first predicted impact point and the second predicted impact point is based, at least in part, on an unsteered trajectory of the guided projectile.

In another example, the projectile dynamics model may be a three DOF model including, at least in part, a steering Jacobian reference. In this example, the first predicted impact point and the second predicted impact point is based, at least in part, on a steered trajectory of the guided projectile.

In yet another example, the at least one projectile dynamics model is at least one of a five DOF model, a six DOF model, and a seven DOF model.

In one example, the smoothed miss distance is a weighted miss distance determined by, at least in part, a weighted sum of the first determined miss distance and the second determined miss distance. In another example, a low pass filter is utilized to determine the smoothed miss distance by filtering the determined miss distances. Although methods of determining the smoothed miss distances have been described, the smoothed miss distances may be determined in other suitable manners.

In another aspect, the present disclosure provides a system and method to aid in guidance, navigation and control of a guided projectile including a precision guidance munition assembly. The system and method receive position estimates of the guided projectile from a guiding sensor, determine predicted impact points of the guided projectile relative to a target based on the position estimates, determine miss distances of the guided projectile relative to the target, determine smoothed miss distances based, at least in part, on the determined miss distances, and process updated steering commands to command the at least one canard on the canard assembly to steer the guided projectile based on the smoothed miss distances.

BRIEF DESCRIPTION OF THE SEVERAL VIEWS OF THE DRAWINGS

Sample embodiments of the present disclosure are set forth in the following description, in the drawings and is particularly and distinctly pointed out and set forth in the appended claims.

Similar numbers refer to similar parts throughout the drawings.

DETAILED DESCRIPTION

Figure 1:
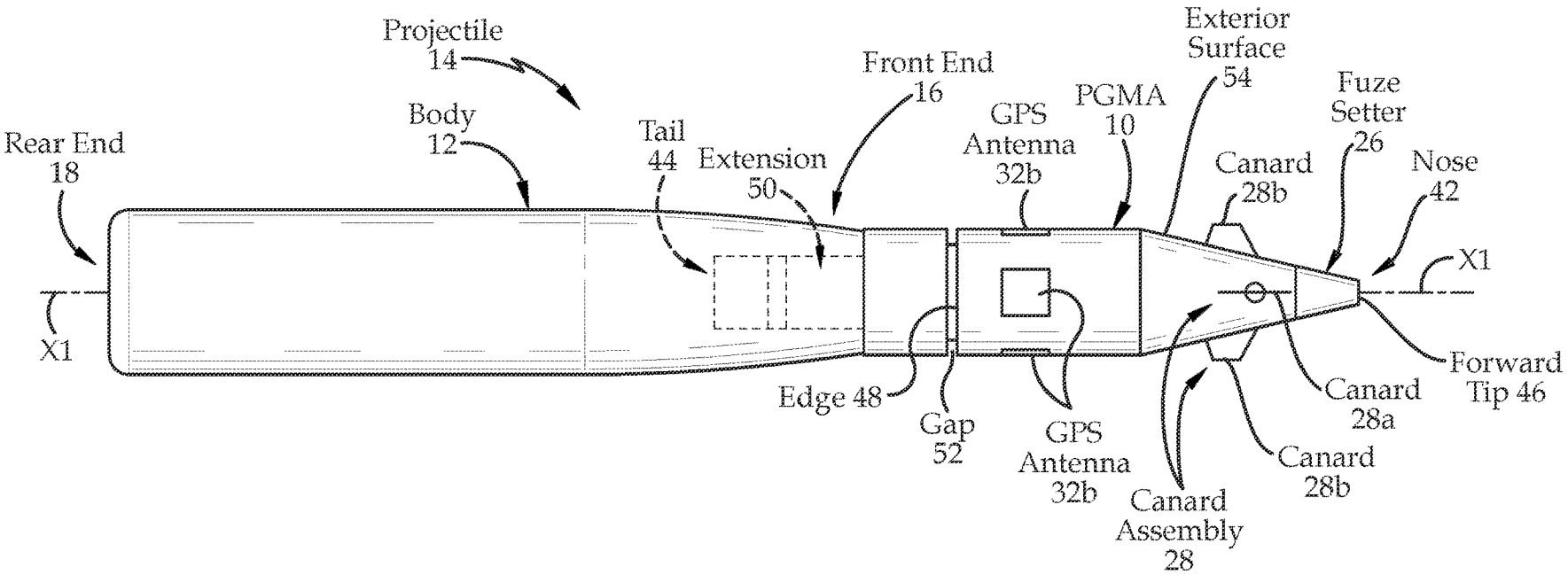
FIG. 1 is a schematic view of a guided projectile including a munition body and a precision guidance munition assembly in accordance with one aspect of the present disclosure.

A precision guidance munition assembly (PGMA), also referred to as a precision guidance kit or PGK in the art, in accordance with the present disclosure is shown generally at 10. As shown in FIG. 1, the PGMA 10 may be operatively coupled with a munition body 12, which may also be referred to as a projectile, to create a guided projectile 14. In one example, the PGMA 10 is connected to the munition body 12 via a threaded connection; however, the PGMA 10 may also be connected to the munition body 12 in any suitable manner. The PGMA 10 can be fastened to the munition body as part of the manufacturing process or afterwards. In one example, such as the APWKS precision guided kit, the PGMA is coupled between the munition body and front end assembly thereby turning an unguided projectile into a precision guided projectile.

Figure 3:
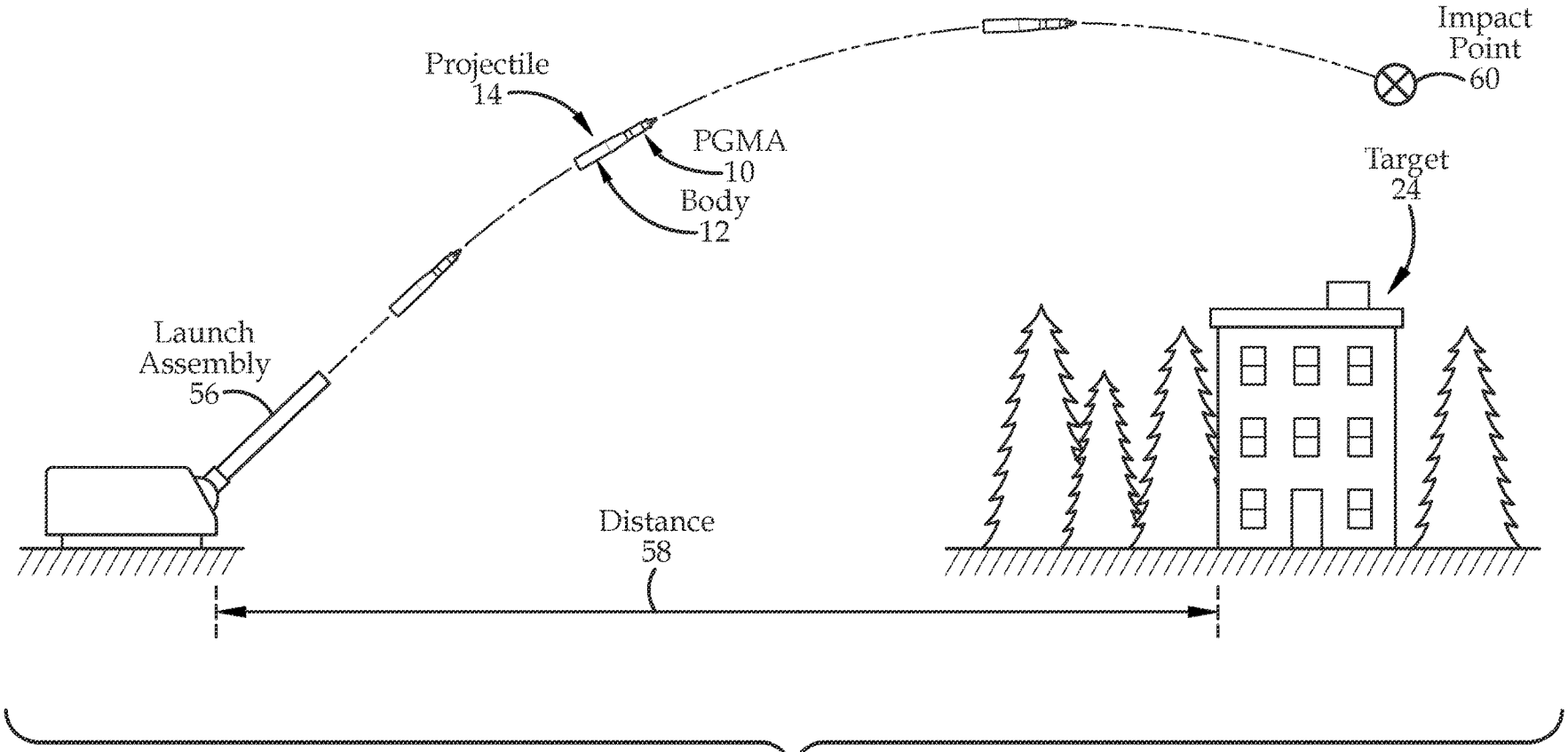
FIG. 3 is an operational schematic view of the guided projectile including the munition body and the precision guidance munition assembly fired from a launch assembly.

FIG. 1 depicts that the munition body 12 includes a front end 16 and an opposite tail or rear end 18 defining a longitudinal direction therebetween. The munition body 12 includes a first annular edge 20 (FIG. 1A), which, in one particular embodiment, is a leading edge on the munition body 12 such that the first annular edge 20 is a leading annular edge that is positioned at the front end 16 of the munition body 12. The munition body 12 may define a cylindrical cavity 22 (FIG. 1A) extending rearward from the first annular edge 20 longitudinally centrally along a center of the munition body 12. The munition body 12 is typically formed from material, such as metal, that is structurally sufficient to carry an explosive charge configured to detonate or explode at, or near, a target 24 (FIG. 3). The munition body 12 may include tail flights (not shown) which help stabilize the munition body 12 during flight.

Figure 1A:
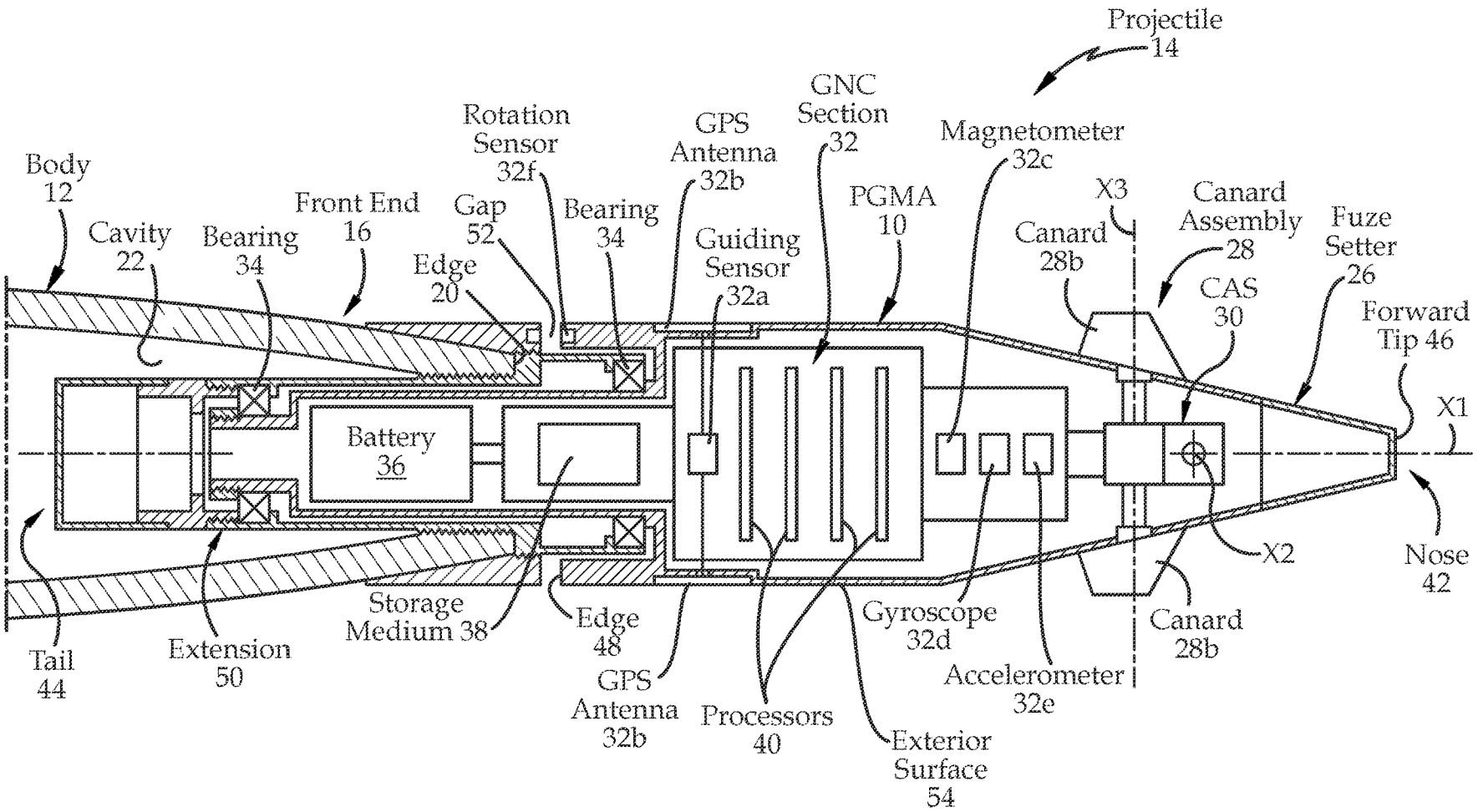
FIG. 1A is an enlarged fragmentary cross-section view of the guided projectile including the munition body and the precision guidance munition assembly in accordance with one aspect of the present disclosure.

FIG. 1 and FIG. 1A depict the PGMA 10 in one example, which may also be referred to as a despun assembly, and includes a fuze setter 26, a canard assembly 28 having one or more canards 28*a*, 28*b*, a control actuation system (CAS) 30, a guidance, navigation and control (GNC) section 32 having a guiding sensor 32*a*, such as a global positioning system (GPS), at least one GPS antenna 32*b*, a magnetometer 32*c*, a microelectromechanical systems (MEMS) gyroscope 32*d*, an MEMS accelerometer 32*e*, and a rotation sensor 32*f*, at least one bearing 34, a battery 36, at least one non-transitory computer-readable storage medium 38, and at least one processor or microprocessor 40.

Although the GNC section 32 has been described in FIG. 1A as having particular sensors, it should be noted that in other examples the GNC section 32 may include other sensors, including, but not limited to, laser guided sensors, electro-optical sensors, imaging sensors, inertial navigation systems (INSs), inertial measurement units (IMUs), or other suitable sensors. In one example, the GNC section 32 may include an electro-optical and/or imaging sensor positioned on a forward portion of the PGMA 10. In another example, there may be multiple sensors employed such that the guided projectile 14 can operate in a GPS-denied environment and for highly accurate targeting. The projectile in one example has multiple sensors and switches from one sensor to another during flight. For example, the projectile can employ GPS while it is available but then switch to another sensor for greater accuracy or if the GPS signal is unreliable or no longer available. For example, it may switch to an imaging sensor to hone in to a precise target.

The at least one computer-readable storage medium 38 may include instructions encoded thereon that when executed by the at least one processor 40 carried by the PGMA 10 implements operations to aid in guidance, navigation and control (GNC) of the guided projectile 14.

The PGMA 10 includes a nose or front end 42 and an opposite tail or rear end 44. When the PGMA 10 is connected to the munition body 12, a longitudinal axis X1 extends centrally from the rear end 18 of the munition body to the front end 42 of the PGMA 10. FIG. 1A depicts one embodiment of the PGMA 10 as generally cone-shaped and defines the nose 42 of the PGMA 10. The one or more canards 28*a*, 28*b* of the canard assembly 28 are controlled via the CAS 30. The PGMA 10 further includes a forward tip 46 and an annular edge 48. In one embodiment, the second annular edge 48 is a trailing annular edge 48 positioned rearward from the tip 46. The second annular edge 48 is oriented centrally around the longitudinal axis X1. The second annular edge 48 on the canard PGMA 10 is positioned forwardly from the first annular edge 20 on the munition body 12. The PGMA assembly 10 further includes a central cylindrical extension 50 that extends rearward and is received within the cylindrical cavity 22 via a threaded connection.

The second annular edge 48 is shaped and sized complementary to the leading edge 20. In one particular embodiment, a gap 52 is defined between the second annular edge 48 and the first annular edge 20. The gap 52 may be an annular gap surrounding the extension 50 that is void and free of any objects so as to effectuate the free rotation of the PGMA 10 relative to the munition body 12.

Figure 2:
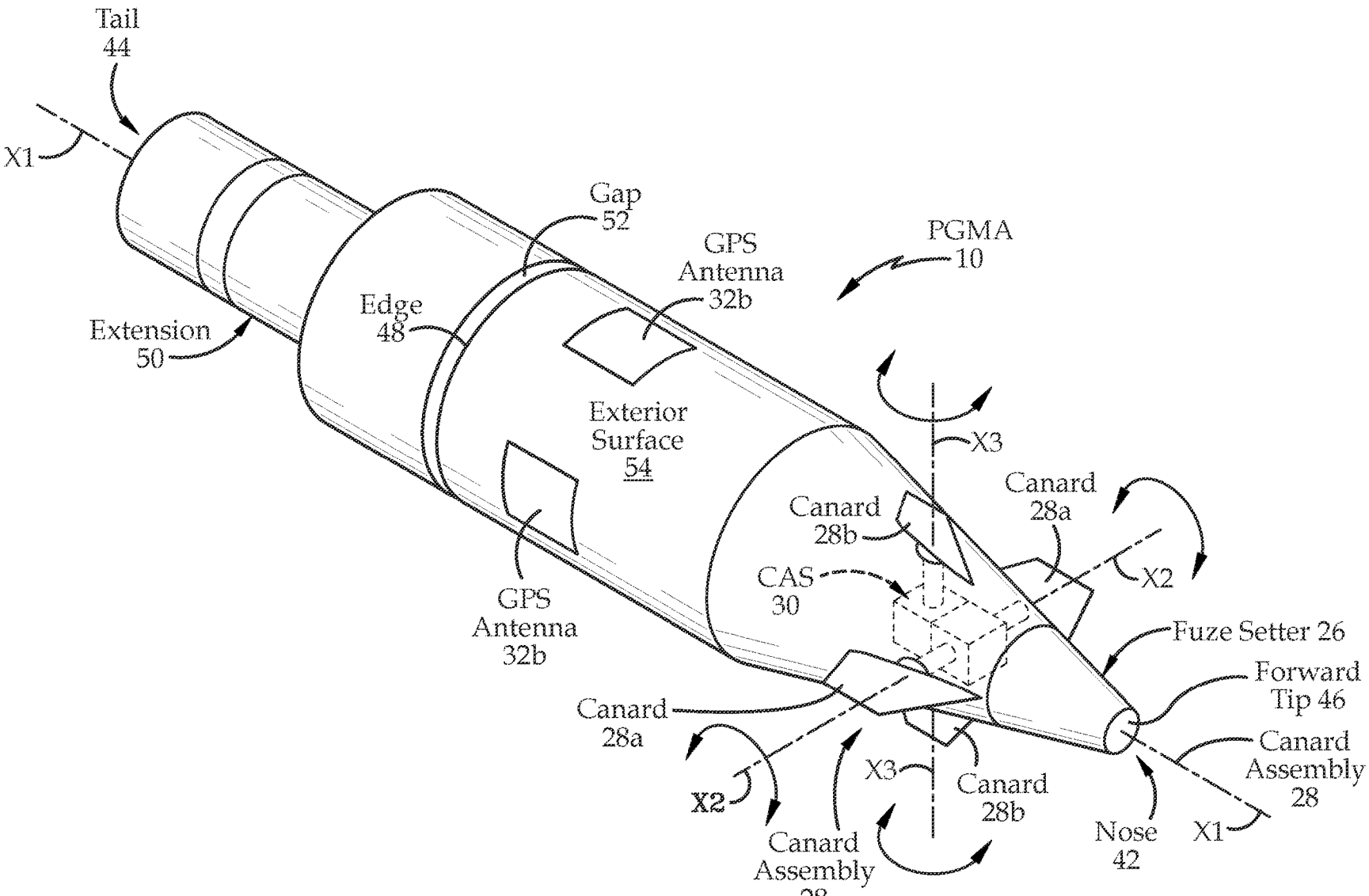
FIG. 2 is a schematic perspective view of precision guidance munition assembly.

FIG. 2 depicts an embodiment of the precision guidance munition assembly, wherein the PGMA 10 includes at least one lift canard 28*a* extending radially outward from an exterior surface 54 relative to the longitudinal axis X1. The at least one lift canard 28*a* is pivotably connected to a portion of the PGMA 10 via the CAS 30 such that the lift canard 28*a* pivots relative to the exterior surface 54 of the PGMA 10 about a pivot axis X2. In one particular embodiment, the pivot axis X2 of the lift canard 28*a* intersects the longitudinal axis X1. In one particular embodiment, a second lift canard 28*a* is located diametrically opposite the at least one lift canard 28*a*, which could also be referred to as a first lift canard 28*a*. The second lift canard 28*a* is structurally similar to the first lift canard 28*a* such that it pivots about the pivot axis X2. The PGMA 10 can control the pivoting movement of each lift canard 28*a* via the CAS 30. The first and second lift canards 28*a* cooperate to control the lift of the guided projectile 14 while it is in motion after being fired from a launch assembly 56 (FIG. 3).

The PGMA 10 in one example further includes at least one roll canard 28*b* extending radially outward from the exterior surface 54 relative to the longitudinal axis X1. In one example, the at least one roll canard 28*b* is pivotably connected to a portion of the PGMA 10 via the CAS 30 such that the roll canard 28*b* pivots relative to the exterior surface 54 of the PGMA 10 about a pivot axis X3. In one particular embodiment, the pivot axis X3 of the roll canard 28*b* intersects the longitudinal axis X1. In one particular embodiment, a second roll canard 28*b* is located diametrically opposite the at least one roll canard 28*b*, which could also be referred to as a first roll canard 28*b*. The second roll canard 28*b* is structurally similar to the first roll canard 28*b* such that it pivots about the pivot axis X3. The PGMA 10 can control the pivoting movement of each roll canard 28*b* via the CAS 30. The first and second roll canards 28*b* cooperate to control the roll of the guided projectile 14 while it is in motion after being fired from the launch assembly 56 (FIG. 3).

FIG. 3 depicts the operation of the PGMA 10 when connected to the munition body 12 forming the guided projectile 14. As shown in FIG. 3, the guided projectile 14 is fired from the launch assembly 56 elevated at a quadrant elevation towards the target 24 located at an estimated or nominal distance 58 from the launch assembly 56. While the launch assembly is shown as a ground vehicle in this example, the launch assembly may also be on vehicles that are air-borne assets or maritime assets. The air-borne assets, for example, includes planes, helicopters and drones.

As stated above, the at least one computer-readable storage medium 38 may include a instructions encoded thereon that when executed by the at least one processor 40 carried by the PGMA 10 implements operations to aid in guidance, navigation and control of the guided projectile 14.

The instructions in one example includes determining a first position estimate of the guided projectile 14 from one or more sensors such as from the GPS 32*a* during flight of the guided projectile 14. In one example the first position estimate can be provided at launch and estimates can be processed and enhanced by subsequent sensor data. The instructions in one example include determining a first predicted impact point 60 of the guided projectile 14 relative to the target 24 based on the first position estimate. In one example, a projectile dynamics model, such as an augmented three DOF model, is utilized to determine the first predicted impact point 60.

An exemplary augmented three DOF model may be provided by the following equations which may be utilized to predict the impact point 60 of the guided projectile 14:

$$xo(t)=cx*qs \quad \text{Equation (1)}$$

where xo(t) is a drag profile for a nominal flight path;

$$xx=xx+vx*dt \quad \text{Equation (2)}$$

$$yy=yy+vy*dt \quad \text{Equation (3)}$$

$$zz=zz+vz*dt \quad \text{Equation (4)}$$

where xx, yy, and zz are the position of the projectile as a function of time and vx, vy, and vz are the components of the projectile velocity as a function of time.

$$b_g=b_g(t) \quad \text{Equation (5)}$$

where Equation (5) provides a gravity Jacobian value at t;

$$c_g=c_g(t) \quad \text{Equation (6)}$$

where Equation (6) is a gravity Jacobian;

$$b_s=b_s(t) \quad \text{Equation(7)}$$

where Equation (7) is a steering Jacobian;

$$c_s=c_s(t) \quad \text{Equation (8)}$$

where Equation (8) is a steering Jacobian;

$$el=el(t) \quad \text{Equation (9)}$$

where Equation (9) is elevation angle versus time of flight;

$$bt=b_s*dy+c_s*dz \quad \text{Equation (10)}$$

where Equation (10) is lateral acceleration due to steering;

$$ct=c_s*dz+c_s+dz \quad \text{Equation (11)}$$

$$afx=dt*xo*(vx/vo)/xmass+dt*(ct+c_g)*\sin(el) \quad \text{Equation (12)}$$

$$afy=dt*xo*(vy/vo)/xmass+dt*(bt+b_g) \quad \text{Equation(13)}$$

$$afz=dt*xo*(vz/vo)/xmass+dt*(ct+c_g)*\cos(el) \quad \text{Equation (14)}$$

$$vx=vx+afx \quad \text{Equation (15)}$$

$$vy=vy+afy \quad \text{Equation(16)}$$

$$vz=vz-g*dt+afz \quad \text{Equation (17)}$$

$$t=t+dt \quad \text{Equation (18)}$$

The $b_g$, $c_g$, $b_s$, and $c_s$ terms are derived from a Jacobian computed from a linear model where the subscript "s" or "g" refers to the steering or gravity Jacobian reference respectively. The augmented three DOF model may be modified or augmented by including the effects of steering and spin as shown in Equation (12) through Equation (14). Additionally, drag may be accounted for by using the drag profile xo(t), Equation(1), and gravity may be accounted as shown in Equation (17).

The loop may start at various times to predict a number of predicted impact points 60. For example, the augmented three DOF model may loop Equation (1) through Equation (18) any time updated information is received, such as when a GPS 32*a* update is received, or at any other suitable time, in order to provide a subsequent predicted impact point 60 to the last predicted impact point 60. Further, the augmented three DOF model may loop Equation (1) through Equation (18) until the end of the guided projectile's flight path or any other period of time.

The augmented three DOF model in one example provides an accurate prediction of the impact point 60 of the guided projectile 14. The augmented three DOF allows the effects of atmospheric drag, steering and aerodynamic trim due to spin and gravity, to be taken into account. The augmented three DOF model may generate a drag profile, a gravity Jacobian, and a steering Jacobian using a nominal flight profile. The drag profile and other terms may be obtained using a seven DOF model to generate the nominal aerodynamic slopes for a nominal flight path. The generated aerodynamic slopes may also be used to form a linear model of the guided projectile 14. The linear model in one example is used to obtain terms that represent the effects of spin, gravity, and steering.

The linear model may be formed by evaluating the following terms over a nominal trajectory:

$$\frac{\partial Z}{\partial w}=\frac{\partial Y}{\partial v}=-\frac{\rho VS}{2}C_{z\alpha} \quad \text{Equation (19)}$$

$$\frac{\partial Z}{\partial \delta_y}=-\frac{\partial Y}{\partial \delta_z}=-\frac{\rho V^2 S}{2}C_{z\delta} \quad \text{Equation (20)}$$

$$\frac{\partial L}{\partial p_F}=\frac{\rho VSd^2}{4}C_{\ell p}^F \quad \text{Equation (21)}$$

$$\frac{\partial L}{\partial \Delta_F}=\frac{\rho V^2 Sd}{2}C_{\ell\Delta}^F \quad \text{Equation (22)}$$

$$\frac{\partial M}{\partial w}=-\frac{\partial N}{\partial v}=\frac{\rho VSd}{2}C_{m\alpha} \quad \text{Equation (23)}$$

-continued $$\frac{\partial M}{\partial q}=-\frac{\partial N}{\partial r}=\frac{\rho VSd^2}{4}C_{mq} \quad \text{Equation (24)}$$

$$\frac{\partial M}{\partial v}=-\frac{\partial N}{\partial w}=\frac{\rho VSd^2 p'_B}{4}C_{n\alpha p} \quad \text{Equation (25)}$$

$$\frac{\partial M}{\partial \delta}=-\frac{\partial N}{\partial \delta}=\frac{\rho V^2 Sd}{d}C_{m\delta} \quad \text{Equation (26)}$$

In Equation (19) through Equation (26), C, within the terms $C_{z\alpha}$, $C_{y\delta}$, $C_{lp}^F$, $C_{l\Delta}^F$, $C_{m\alpha}$, $C_{mq}$, $C_{n\alpha p}$, and $C_{m\delta}$, represents Mach dependent linear aerodynamic terms. A linear model may be formed using the terms:

$$\dot{v}=(-u)r+\frac{1}{m}\left(\frac{\partial Y}{\partial v}\right)(v+v_w)+\frac{1}{m}\left(\frac{\partial Y}{\partial \delta}\right)\delta_Z+g_y \quad \text{Equation (27)}$$

$$\dot{w}=(u)q+\frac{1}{m}\left(\frac{\partial Z}{\partial w}\right)(w+w_w)+\frac{1}{m}\left(\frac{\partial Z}{\partial \delta}\right)\delta_y+g_Z \quad \text{Equation (28)}$$

$$\dot{p}_F=\left(\frac{1}{A_F}\frac{\partial L}{\partial p_F}\right)p_F+\left(\frac{1}{A_F}\frac{\partial L}{\partial \Delta_F}\right)\Delta_F+\frac{T}{A_F} \quad \text{Equation (29)}$$

$$\dot{q}=\left(\frac{1}{B}\frac{\partial M}{\partial w}\right)(w+w_w)+\left(\frac{1}{B}\frac{\partial M}{\partial q}\right)q+\left(\frac{1}{B}\frac{\partial M}{\partial v}\right)(v+v_w)+\left(\frac{1}{B}\frac{\partial M}{\partial \delta}\right)\delta_y-\frac{A_B p_B}{B}r \quad \text{Equation (30)}$$

$$\dot{r}=\left(\frac{1}{B}\frac{\partial N}{\partial v}\right)(v+v_w)+\left(\frac{1}{B}\frac{\partial N}{\partial r}\right)r+\left(\frac{1}{B}\frac{\partial N}{\partial w}\right)(w+w_w)+\left(\frac{1}{B}\frac{\partial N}{\partial \delta}\right)\delta_Z-\frac{A_B p_B}{B}q \quad \text{Equation (31)}$$

Equations (27) through Equation (31) form a linear model. The linear model can be written in a more compact form defining and using following:

$$V_v=\frac{1}{m}\frac{\partial Y}{\partial v}=\frac{1}{m}\frac{\partial Z}{\partial w}=W_w=-\frac{\rho VS}{2m}C_{z\alpha} \quad \text{Equation (32)}$$

$$-V_r=W_q=u \quad \text{Equation (33)}$$

$$-V_{\delta_z}=-\frac{1}{m}\frac{\partial Y}{\partial \delta_z}=\frac{1}{m}\frac{\partial Z}{\partial \delta_y}=W_{\delta_y}=-\frac{\rho V^2 S}{2m}C_{z\delta} \quad \text{Equation (34)}$$

$$Q_V=\frac{1}{B}\frac{\partial M}{\partial v}=\frac{1}{B}\frac{\partial N}{\partial w}=R_w=\frac{\rho Sd^2 P'_B}{4B}C_{n\alpha p} \quad \text{Equation (35)}$$

$$Q_W=\frac{1}{B}\frac{\partial M}{\partial w}=-\frac{1}{B}\frac{\partial N}{\partial v}=-R_v=\frac{\rho VSd}{2B}c_{m\alpha} \quad \text{Equation (36)}$$

$$Q_q=\frac{1}{B}\frac{\partial M}{\partial q}=\frac{1}{B}\frac{\partial N}{\partial r}=R_r=\frac{\rho VSd^2}{4B}C_{mq} \quad \text{Equation (37)}$$

$$-Q_r=+R_Q=\frac{A_B p'_B}{B} \quad \text{Equation (38)}$$

$$-Q_\delta=\frac{1}{B}\frac{\partial M}{\partial \delta}=+\frac{1}{B}\frac{\partial N}{\partial \delta}=+R_\delta=\frac{\rho V^2 Sd}{2B}C_{m\delta} \quad \text{Equation (39)}$$

The resulting linear model may be written as:

$$\dot{p}_F = P_p p_F + P_\Delta \Delta_F + P_T T \quad \text{Equation (40)}$$

$$\begin{pmatrix} \dot{v} \\ \dot{w} \\ \dot{q} \\ \dot{r} \end{pmatrix} = \begin{pmatrix} V_V & 0 & 0 & v_r \\ 0 & W_w & W_q & 0 \\ Q_V & Q_w & Q_q & Q_r \\ R_V & R_w & R_q & R_r \end{pmatrix} \begin{pmatrix} v \\ w \\ q \\ r \end{pmatrix} + \begin{pmatrix} 0 & V_{\delta_z} & 1 & 0 & V_V & 0 \\ W_{\delta_y} & 0 & 0 & 1 & 0 & W_w \\ Q_\delta & 0 & 0 & 0 & Q_V & Q_w \\ 0 & R_\delta & 0 & 0 & R_V & R_w \end{pmatrix} \begin{pmatrix} \delta_y \\ \delta_Z \\ g_y \\ g_z \\ v_w \\ w_w \end{pmatrix} \quad \text{Equation (41)}$$

$$\begin{pmatrix} b \\ c \\ \alpha \\ \beta \end{pmatrix} = \begin{pmatrix} V_V & 0 & 0 & 0 \\ 0 & W_w & 0 & 0 \\ 0 & 1/V & 0 & 0 \\ 1/V & 0 & 0 & 0 \end{pmatrix} \begin{pmatrix} v \\ w \\ q \\ r \end{pmatrix} + \begin{pmatrix} 0 & V_{\delta_z} & 0 & 0 & V_V & 0 \\ W_{\delta_y} & 0 & 0 & 0 & 0 & W_w \\ 0 & 0 & 0 & 0 & 0 & 1/V \\ 0 & 0 & 0 & 0 & 1/V & 0 \end{pmatrix} \begin{pmatrix} \delta_y \\ \delta_z \\ g_y \\ g_z \\ v_w \\ w_w \end{pmatrix} \quad \text{Equation (42)}$$

To obtain the trim state, the left hand side of the Equation (40) may be set to zero as follows:

$$\begin{pmatrix} \dot{v} \\ \dot{w} \\ \dot{q} \\ \dot{r} \end{pmatrix} = 0 \quad \text{Equation (43)}$$

The solution of Equation (42) may provide trim values for v, w, q and r as a function of steering, $\delta_y$ and $\delta_z$, and gravity, $g_y$ and $g_z$. The trim values may be used in Equation (41) to compute trim values for lateral accelerations, b and c. The lateral accelerations, b and c, may be used in the three DOF model. The drag profile may be used to provide a value for aerodynamic drag which may be denoted as "a" and may be used in the three DOF model.

It should be understood that although the projectile dynamics model has been described as an augmented three DOF model, the projectile dynamics model may be any suitable projectile dynamics model. For example, the projectile dynamics model may be a three DOF model including, at least in part, a Jacobian reference, a three DOF model including, at least in part, a drag profile, a three DOF model including, at least in part, a steering Jacobian reference accounting for, at least in part, steering applied to the guided projectile 14, a five DOF model, a six DOF model, and a seven DOF model. The various DOF models, such as the augmented three DOF model, the five DOF model, the six DOF model, and the seven DOF model may vary in accuracy and complexity and the type of DOF model utilized with the teachings of the present disclosure may depend on particular applications and configurations.

The instructions may further include determining a first miss distance of the guided projectile 14 relative to the target 24. The first miss distance in this example is defined as the distance between the first predicted impact point 60 and the target 24.

The instructions in one example include determining a second position estimate of the guided projectile 14 from the sensors such as the GPS 32*a* during flight of the guided projectile 14. The instructions include determining a second predicted impact point 60 of the guided projectile 14 relative to the target 24 based on the first position estimate. In one example, a projectile dynamics model, such as an augmented three DOF model, is utilized to determine the first predicted impact point 60. The instructions further include determining a second miss distance of the guided projectile 14 relative to the target 24. The second miss distance may be defined as the distance between the second predicted impact point 60 and the target 24.

The instructions in one example includes determining a smoothed miss distance. In one example, determining the smoothed miss distance is based, at least in part, on the first determined miss distance and the second determined miss distance. In another example, the smoothed miss distance is a weighted miss distance determined by, at least in part, a weighted sum of the first determined miss distance and the second determined miss distance. The weighted sum in one example is weighted by a weight "A." The value of the weight A may be between zero and one and depends on the noise of the sensors, including the GPS 32*a* and bias effects of the projectile dynamics model. In one example, the weight A is one-half (0.5), however, weight A may be another suitable value. In another example, weight A is time dependent A(t) and varies with time.

In another example, a low pass filter is utilized to determine the smoothed miss distance by filtering the determined miss distances. For example, and not meant as a limitation, the instructions determine miss distances every second along the guided projectile's flight path and a cutoff frequency of the low pass filter is between approximately one-fifth (0.2) and one-half (0.5) Hertz. Other cut-off frequencies are also within the scope of the system. Although particular methods for determining the smoothed miss distances have been described, the smoothed miss distances may be determined in other suitable manners.

The instructions in one example include processing an updated steering command to command the at least one canard on the canard assembly to move its position based on the smoothed miss distance.

The above-described instructions may be iterated until the end of the guided projectile's 14 flight path or any other desired time period. For example, the instructions may continuously receive position estimates over a specified period time, such as every second of the guided projectile's flight path, continuously predict impact points 60 of the guided projectile 14 until a desired point in time or until the point of impact of the guided projectile 14; continuously determine miss distances; continuously smooth miss distances and continuously process updated steering commands to the PGMA 10 to move the at least one canard 28*a*, and 28*b*. As described above, the updated steering commands are generated based on the difference between the predicted impact points 60 and the location of the target 24. Since the instructions may continuously provide predicted impact points 60, the bias effects associated with the projectile dynamics model tend to zero as the target 24 is approached.

Further, in one example, the projectile dynamics model provides constraints that reduce the effect of measurement noise.

Figure 4:
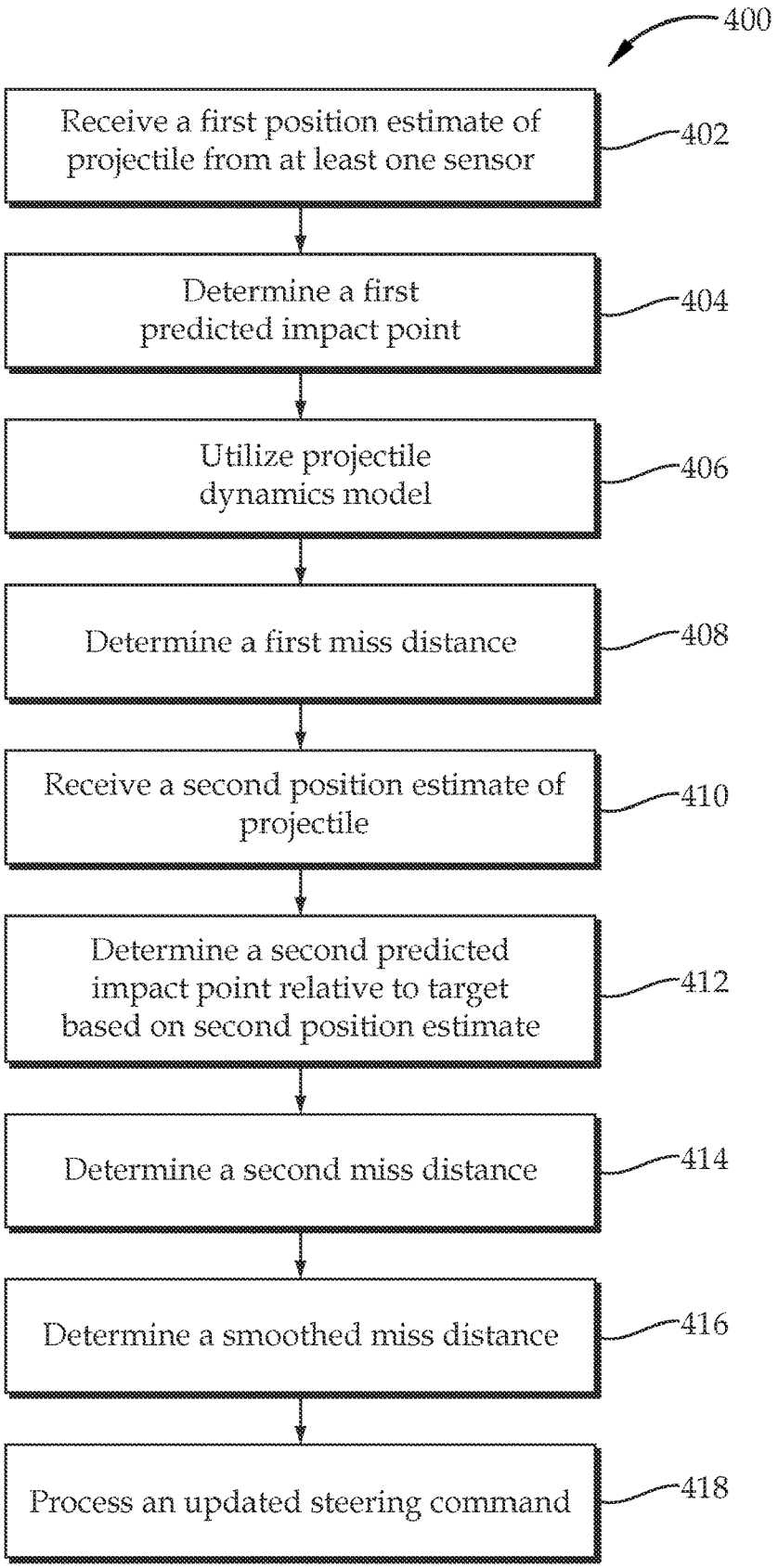
FIG. 4 is a flow chart of one method or process of the present disclosure.

FIG. 4 is a flow chart of one method or process in accordance with the present disclosure and is generally indicated at 400. The method 400 include receiving a first position estimate of the guided projectile 14 including the precision guidance munition assembly 10 from the at least one sensor such as a guiding sensor 32*a*, which is shown generally at 402. In one example, the PGMA 10 includes a canard assembly 28 including at least one canard 28*a*, 28*b* that is moveable and allows steering of the projectile in flight.

The method 400 in this example includes determining a first predicted impact point of the guided projectile 14 relative to a target 24 based on the first position estimate, shown generally at 404. The method 400 in one example includes utilizing a projectile dynamics model to predict the first impact point 60 of the guided projectile 14 relative to the target 24, shown generally at 406.

In one example, the projectile dynamics model may be a three DOF model including, at least in part, a Jacobian reference and/or a drag profile. In this example, the first predicted impact point 60 is based, at least in part, on an unsteered trajectory of the guided projectile 14.

In another example, the projectile dynamics model is a three DOF model including, at least in part, a steering Jacobian reference. In this example, first predicted impact point and the second predicted impact point are based, at least in part, on a steered trajectory of the guided projectile. In yet another example, the at least one projectile dynamics model is at least one of a five DOF model, a six DOF model, and a seven DOF model.

The method 400 in further example includes determining a first miss distance of the guided projectile 14 relative to the target 24, shown generally at 408. The method 400 includes receiving a second position estimate of the guided projectile 14 from the guiding sensor 32*a*, shown generally at 410. The method 400 includes determining a second predicted impact point of the guided projectile 14 relative to the target 24 based on the second position estimate, shown generally at 412. The method 400 includes determining a second miss distance of the guided projectile 14 relative to the target 24, shown generally at 414. The method 400 includes determining a smoothed miss distance, shown generally at 416.

In one example, determining the smoothed miss distance is based, at least in part, on the first determined miss distance and the second determined miss distance. In one example, the smoothed miss distance is a weighted miss distance determined by, at least in part, a weighted sum of the first determined miss distance and the second determined miss distance. The weighted sum in one example is weighted by a weight "A." The value of the weight A in one example is between zero and one and depends on the noise of the GPS 32*a* and bias effects of the projectile dynamics model. In one example, the weight A is one-half (0.5), however, weight A may be other values depending upon the specifics. In another example, weight A is time dependent A(t) such that it changes over time.

In another example, a low pass filter is utilized to determine the smoothed miss distance by filtering the determined miss distances. For example, and not meant as a limitation, the instructions determine miss distances every second along the guided projectile's flight path and a cutoff frequency of the low pass filter is between approximately one-fifth (0.2) and one-half (0.5) hertz; however, the cutoff frequency may be another suitable frequency. Although particular methods for determining the smoothed miss distances have been described, the smoothed miss distances may be determined in other suitable manners.

The method 400 in this example includes processing an updated steering command to command the at least one canard 28*a*, 28*b*, on the canard assembly 28 to steer the guided projectile 14 based on the smoothed miss distance, which is shown generally at 418.

Figure 5:
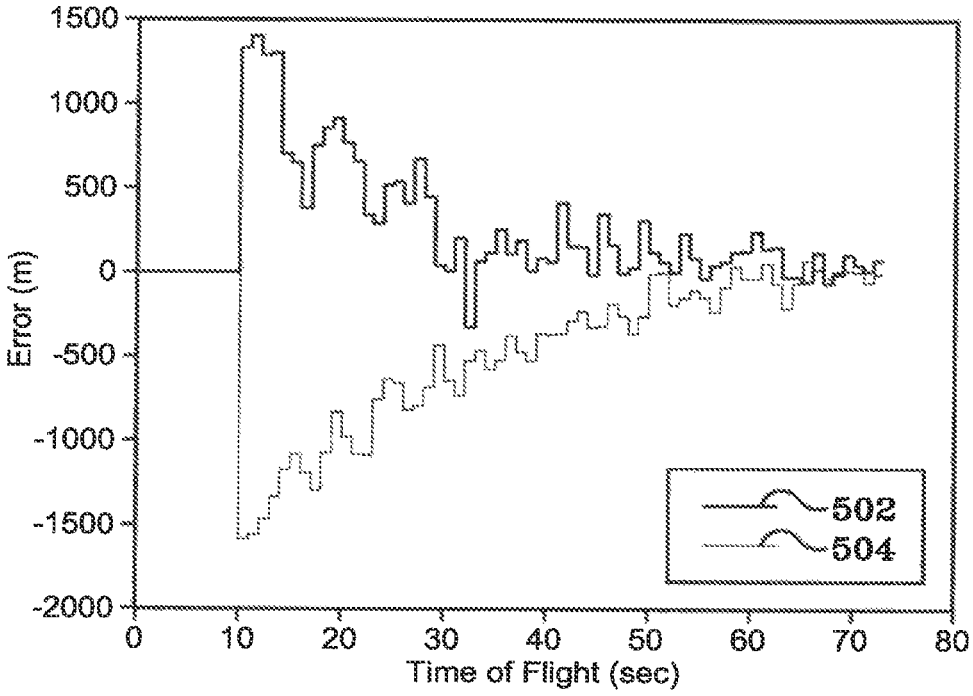
FIG. 5 is a graph of prediction error in meters versus time of flight of the guided projectile in seconds for a conventional three degree-of-freedom model.

FIG. 5 is a graph of prediction error in meters versus time of flight of the guided projectile 14 in seconds for a conventional three DOF model. Line 502 represents down range error and line 504 represents cross range error along the guided projectile's 14 flight path. As shown in FIG. 5, the modeling error has a large bias at the beginning of the guided projectile's 14 flight path.

Figure 6:
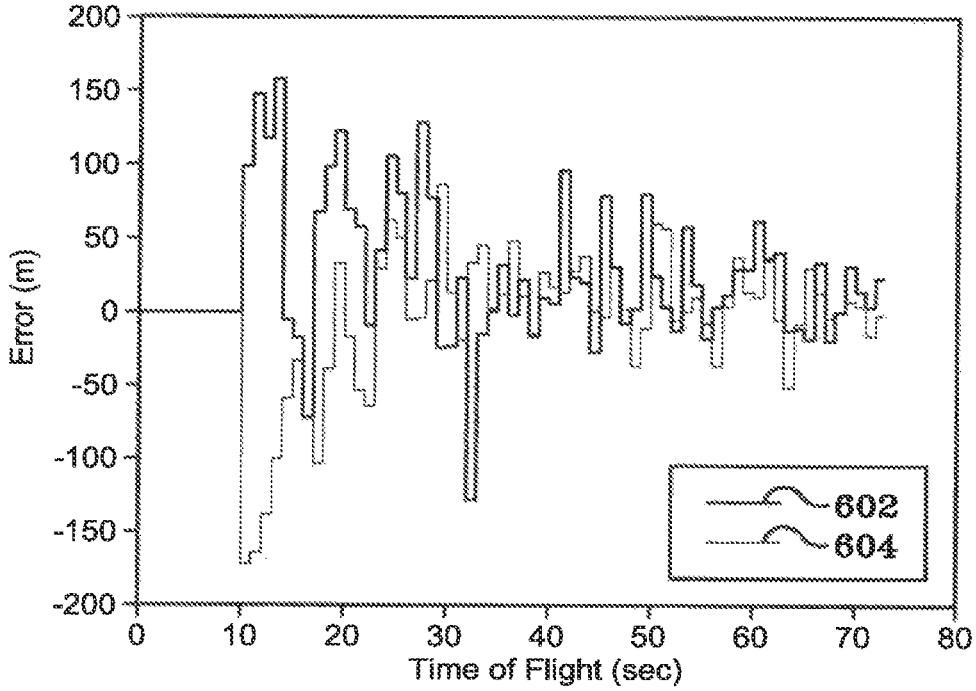
FIG. 6 is a graph of prediction error in meters versus time of flight of the guided projectile in seconds for an augmented three degree-of-freedom model.

FIG. 6 is a graph of prediction error in meters versus time of flight of the guided projectile 14 in seconds for an augmented three DOF model in accordance with the present disclosure. Line 602 represents cross range error and line 604 represents down range error along the guided projectile's 14 flight path. As shown in FIG. 6, and when compared to the modeling error shown in FIG. 5, the modeling error has a smaller bias at the beginning of the guided projectile's 14 flight path. Further, the errors associated with FIG. 6 are smaller than the errors associated with FIG. 5 due to the augmentation of the three DOF model in accordance with the teachings of the present disclosure.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer, tablet, smartphone, or similar device utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers, tablets, smartphones and similar devices may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program," "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Guided projectile" or guided projectile 14 refers to any launched projectile such as rockets, mortars, missiles, cannon shells, shells, bullets and the like that are configured to have in-flight guidance.

"Launch Assembly" or launch assembly 56, as used herein, refers to rifle or rifled barrels, machine gun barrels, shotgun barrels, howitzer barrels, cannon barrels, naval gun barrels, mortar tubes, rocket launcher tubes, grenade launcher tubes, pistol barrels, revolver barrels, chokes for any of the aforementioned barrels, and tubes for similar weapons systems, or any other launching device that imparts a spin to a munition round or other round launched therefrom.

In some embodiments, the munition body 12 is a rocket that employs a precision guidance munition assembly 10 that is coupled to the rocket and thus becomes a guided projectile 14.

"Precision guided munition assembly," as used herein, should be understood to be a precision guidance kit, precision guidance system, a precision guidance kit system, or other name used for a guided projectile.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process steps of the present disclosure, which may incorporate some aspects of natural phenomenon, the process or method steps are additional features that are new and useful.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A precision guidance munition assembly for a guided projectile, comprising:

a canard assembly coupled to the precision guidance munition assembly including at least one canard, wherein the at least one canard is moveable;

at least one guiding sensor coupled to the precision guidance munition assembly; and at least one non-transitory computer-readable storage medium carried by the precision guidance munition assembly having a set of instructions encoded thereon that when executed by at least one processor operates to aid in guidance, navigation and control of the guided projectile, wherein the set of instructions comprise:

receive a first position estimate of the guided projectile;

determine a first predicted impact point of the guided projectile relative to a target based on the first position estimate;

determine a first miss distance of the guided projectile relative to the target;

receive a second position estimate of the guided projectile from the guiding sensor;

determine a second predicted impact point of the guided projectile relative to the target based on the second position estimate;

determine a second miss distance of the guided projectile relative to the target;

determine a smoothed miss distance based, at least in part, on the first determined miss distance and the second determined miss distance; and process an updated steering command to command the at least one canard on the canard assembly to steer the guided projectile based on the smoothed miss distance.

2. The precision guidance munition assembly of claim 1, wherein the at least one canard includes a first lift canard and a second lift canard.

3. The precision guidance munition assembly of claim 1, wherein the at least one canard includes a first roll canard and a second roll canard.

4. The precision guidance munition assembly of claim 1, wherein the set of instructions further include:

utilize a projectile dynamics model to determine at least one of the first predicted impact point and the second predicted impact point.

5. The precision guidance munition assembly of claim 4, wherein the projectile dynamics model is a three degree-of-freedom model including, at least in part, a Jacobian reference.

6. The precision guidance munition assembly of claim 4, wherein the projectile dynamics model is a three degree-of-freedom model including, at least in part, a drag profile.

7. The precision guidance munition assembly of claim 4, wherein the projectile dynamics model is a three degree-of-freedom model including, at least in part, a steering Jacobian reference accounting for, at least in part, steering applied to the guided projectile.

8. The precision guidance munition assembly of claim 4, wherein the projectile dynamics model is a five degree-of-freedom model, a six degree-of-freedom model, or a seven degree-of-freedom model.

9. The precision guidance munition assembly of claim 1, wherein the first position estimate of the guided projectile is from the guiding sensor.

10. The precision guidance munition assembly of claim 1, wherein the guiding sensor is at least one of a laser-guided sensor, electro-optical sensor, imaging sensor, inertial navigation system (INSs), inertial measurement unit (IMUs), and electro-optical sensor.

11. The precision guidance munition assembly of claim 1, wherein the smoothed miss distance is a weighted miss distance determined by, at least in part, a weighted sum of the first determined miss distance and the second determined miss distance.

12. A method, comprising:

receiving a first position estimate of a guided projectile including a precision guidance munition assembly from a guiding sensor; wherein the precision guidance munition assembly includes a canard assembly including at least one canard wherein the at least one canard is moveable;

determining a first predicted impact point of the guided projectile relative to a target based on the first position estimate;

determining a first miss distance of the guided projectile relative to the target;

receiving a second position estimate of the guided projectile from the guiding sensor;

determining a second predicted impact point of the guided projectile relative to the target based on the second position estimate;

determining a second miss distance of the guided projectile relative to the target;

determining a smoothed miss distance based, at least in part, on the first determined miss distance and the second determined miss distance; and processing a steering command to command the at least one canard on the canard assembly to steer the guided projectile based on the smoothed miss distance.

13. The method of claim 12, wherein the at least one canard includes a first lift canard and a second lift canard.

14. The method of claim 12, wherein the at least one canard includes a first roll canard and a second roll canard.

15. The method of claim 12, further comprising:

utilizing a projectile dynamics model to determine the first predicted impact point and the second predicted impact point.

16. The method of claim 15, wherein the projectile dynamics model is a three degree-of-freedom model including, at least in part, a Jacobian reference and a drag profile.

17. The method of claim 16, wherein the first predicted impact point and the second predicted impact point are based, at least in part, on an unsteered trajectory of the guided projectile.

18. The method of claim 15, wherein the projectile dynamics model is a three degree-of-freedom model including, at least in part, a steering Jacobian reference.

19. The method of claim 18, wherein the first predicted impact point and the second predicted impact point are based, at least in part, on a steered trajectory of the guided projectile.

20. The method of claim 12, wherein the smoothed miss distance is a weighted miss distance determined by, at least in part, a weighted sum of the first determined miss distance and the second determined miss distance.

* * * * *